US005347764A

United States Patent [19]

Pennison

[11] Patent Number: 5,347,764

[45] Date of Patent: Sep. 20, 1994

[54] HANDLE ARRANGEMENT FOR AIR POWER TOOL

[75] Inventor: Robert A. Pennison, Bellville, Tex.

[73] Assignee: Indresco Inc., Dallas, Tex.

[21] Appl. No.: 24,988

[22] Filed: Mar. 2, 1993

[51] Int. Cl.[5] ..... B24B 23/00

[52] U.S. Cl. ..... 451/359; 451/322

[58] Field of Search ..... 51/170 R, 170 PT, 170 T, 51/134.5 F, 268, 273, 170 MT, 270; 15/97.1, 49.1, 22.1, 28, 21.1

[56] References Cited

U.S. PATENT DOCUMENTS

| | | | |
|---|---|---|---|
| D. 153,174 | 3/1949 | Riddle et al. . | |
| D. 252,731 | 8/1979 | Parise . | |
| D. 252,880 | 9/1979 | Dummermath . | |
| D. 256,881 | 9/1980 | Hutchins . | |
| D. 262,185 | 12/1981 | Huber et al. . | |
| D. 295,253 | 4/1988 | Ashworth . | |
| D. 297,778 | 9/1988 | Lallerstedt . | |
| 973,894 | 10/1910 | Toomey . | |
| 1,802,078 | 4/1931 | Exley . | |
| 2,149,645 | 3/1939 | Sittert . | |
| 2,422,733 | 6/1947 | Jimerson . | |
| 2,422,755 | 6/1947 | Strother . | |
| 2,441,624 | 5/1948 | Elliott . | |
| 2,586,968 | 2/1952 | Maclay . | |
| 3,043,273 | 7/1962 | Schott . | |
| 3,071,115 | 1/1963 | Schott . | |
| 3,257,913 | 6/1966 | Broom et al. . | |
| 3,279,485 | 10/1966 | Alexander . | |
| 3,312,258 | 4/1967 | Spampinato . | |
| 3,334,448 | 8/1967 | Alexander . | |
| 3,421,414 | 1/1969 | Peale . | |
| 3,519,372 | 7/1970 | Peale . | |
| 3,749,530 | 7/1973 | Amador . | |
| 3,775,911 | 12/1973 | Flagge | 51/170 T |
| 3,934,657 | 1/1976 | Danielson | 51/170 T |
| 4,059,930 | 11/1977 | Alessio . | |
| 4,103,460 | 8/1978 | Law . | |
| 4,145,848 | 3/1979 | Hutchins . | |
| 4,330,967 | 5/1982 | Richardson . | |
| 4,558,539 | 12/1985 | Hansson . | |
| 4,683,682 | 8/1987 | Pennison . | |
| 4,729,436 | 3/1988 | Amador . | |

FOREIGN PATENT DOCUMENTS

| | | | |
|---|---|---|---|
| 0489980 | 1/1930 | Fed. Rep. of Germany | 51/170 T |
| 0543495 | 11/1932 | Fed. Rep. of Germany | 51/170 T |

OTHER PUBLICATIONS 1700 and 1900 Series Vertical Grinder, Catalog p. G-23, dated Aug. 1987.

*Primary Examiner*—Roscoe V. Parker

[57] ABSTRACT

An air tool includes a housing containing an air motor with a shaft rotatable about a longitudinal axis and connectable to an implement for working the surface of a workpiece. Power handle and idle handles have upper and lower ends connected to the housing at angularly spaced locations. Air power is supplied to the motor by an air passage extending through the power handle to an intake at the top of the housing. The upper and lower connections of the handles to the housing have axes extending generally perpendicular to each other and vibration insulators prevent metal to metal contact with the housing. One of the vibration insulators also is used in sealing against the loss of power air before entering the motor. Between their upper and lower ends, the handles are slanted at an angle of about fifteen degrees (15°) relative to the axis of the tool.

29 Claims, 4 Drawing Sheets

HANDLE ARRANGEMENT FOR AIR POWER TOOL

BACKGROUND OF THE INVENTION

1. Technical Field

This invention relates to air powered tools and is primarily concerned with an improvement in the arrangement for the mounting of handles on the housing of an air powered tool such as a grinder.

2. Background Information

The maneuverability of hand-held air powered tools such as grinders has popularized their use for a wide variety of production tasks for both large and small products. Some grinders are termed vertical grinders. A conventional vertical grinder includes a housing containing a pneumatically driven motor with a vertical power shaft serving as the spindle carrying a grinding wheel. One such grinder is shown in U.S. Pat. No. 3,749,530, wherein a pair of horizontal handles are attached to a cast housing. Pneumatic power is supplied to drive the air motor by way of a power air passage having one portion extending through one of the handles and a second portion cast into the housing. The portion of the passage through the housing connects with an intake opening to the motor at the top of the housing. More recently, grinders such as the one disclosed in U.S. Pat. No. 4,330,967 have been equipped with a guard completely surrounding the grinding wheel at the rear of the housing beneath the handles and having an open front area.

Under most service use conditions, the operator of a vertical grinder of the foregoing type positions the grinding wheel so that it is tilted slightly out of the surface plane of the workpiece with the forward peripheral edge of the wheel along the open front of the guard performing the majority of the work. The surface to be worked may be in any angular position from horizontal, to vertical to directly overhead of the operator.

Of importance to the versatility of the tool is that it provide a wide latitude and freedom of postures from which it can be easily operated. Moreover, it is of specific importance to the speed, quality and quantity of work performed using such grinders that the effort required of the operator in holding the grinder in any working position, even for extended periods of time, be kept to a minimum and that factors tending to fatigue an operator be eliminated if not reduced substantially wherever possible.

SUMMARY OF THE INVENTION

The present invention generally contemplates the provision of a new and improved air powered tool of the foregoing general character which is less expensive to produce and yet is easier and less wearing for the operator of the tool to use. More specifically, the present invention aims to accomplish this at least in part by the simplification of the casting of the motor housing. In particular, the present invention employs a novel arrangement for delivering power air directly to the motor by utilizing one of the handles to deliver power air directly to an air inlet port at the top of the motor housing rather than through the housing.

Invention also resides in the relative angular positioning of the handles of the tool to make it easier for a user of the tool to naturally orient the tool relative to a workpiece in its most effective and easily handled position. Still further, the invention resides in the novel manner of solidly and securely connecting the handles to the motor housing so as to remain functionally rigid and yet provide vibration attenuation during use. Specifically, this is accomplished through the provision of unique handles having both upper and lower ends connected to the housing and with the upper and lower connections having longitudinal axes which are perpendicular to each other.

An additional object of the invention is to effectively attenuate the transmission of fatiguing vibration to the hands of an operator through the provision of vibration insulators in the upper and lower connections of the handles to the motor housing. Invention also resides in the dual use of a set of the vibration insulators to also seal against the leakage of power air from around the connection of the power air passage to inlet port in the motor housing.

Still further invention resides in an alternative embodiment including an elongated grip attached to the housing and protruding axially therefrom generally along the axis of the grinder motor to provide an alternate hand position for ease of use of the grinder in a horizontal position.

The foregoing and other advantages of the present invention will become more apparent from the following description of the preferred embodiment when taken in conjunction with the accompanying drawings.

BEST MODE FOR CARRYING OUT THE INVENTION

Figure 1:
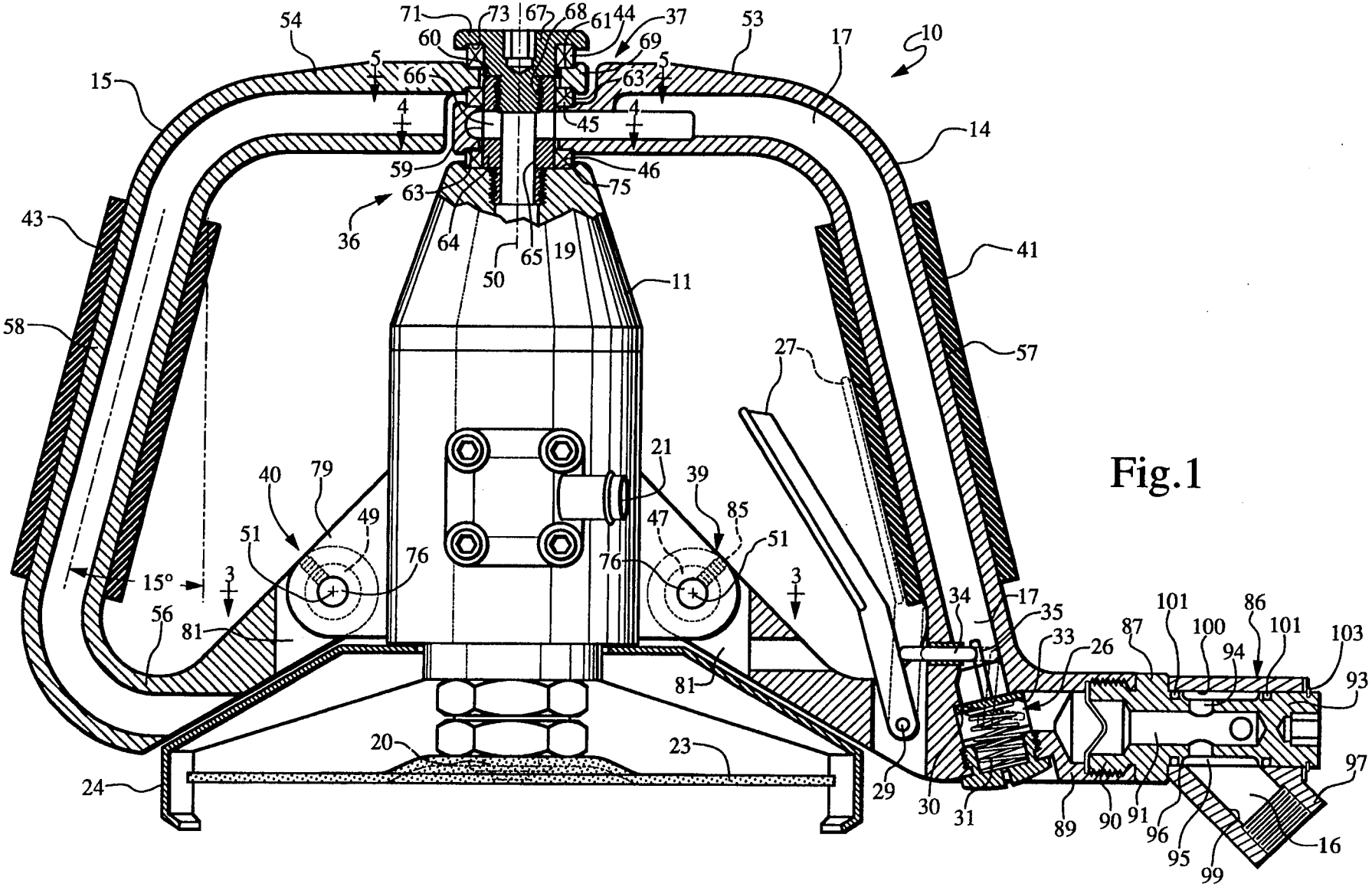
FIG. 1 is an elevational cross-sectional view of an air tool embodying the novel features of the present invention.

As shown in the drawings for purposes of illustration, the present invention is embodied in an air power tool such as a vertical grinder 10. Herein, the grinder includes a cast housing 11 (see FIG. 1) within which is mounted an air powered motor (not shown). Operator handles 14 and 15 are secured to the exterior of the housing. An air power inlet 16 in the handle 14, the power handle, connects with a passage 17 leading to an air intake 19 for the motor adjacent the top of the housing. Air from the intake flows through the motor acting against vanes on a rotor (not shown) to rotate a vertical shaft or spindle 20. After passing through the motor, the exhaust air exits the housing through an exhaust port 21.

Carried on the lower end of the spindle 20 is a thin disc grinding wheel 23. Attached to the housing around the spindle is an arcuate guard 24 having a generally frustoconical upper surface with a horizontal portion attached to the bottom of the motor housing 11. Inwardly formed with the frustoconical upper wall is a generally vertical outer wall having an opening 25 (see FIG. 2) at the front so that a portion of the periphery of the grinding disc 23 is exposed for grinding against the surface of a workpiece.

Control of the power air to the motor is provided by way of a valve 26 mounted within the power handle 14. The valve is actuated through a control lever 27 pivotally connected by a pin 29 to the power handle. As shown in FIG. 1, the valve includes a closure plate 30 urged by a spring 31 into a closed position against a valve seat 33. To increase the flow of power air to the motor and thereby increase the speed of the grinding wheel 23, the tool operator squeezes the lever 27 toward the handle 14 causing linkages 34 and 35 to urge the valve plate against the spring. As the valve plate moves away from the seat, such as into the dotted line position shown in FIG. 1, the flow of power air past the seat increases, causing more air to flow through the motor and increase the speed of the grinding wheel up to the speed at which a governor (not shown) takes control.

Figure 3:
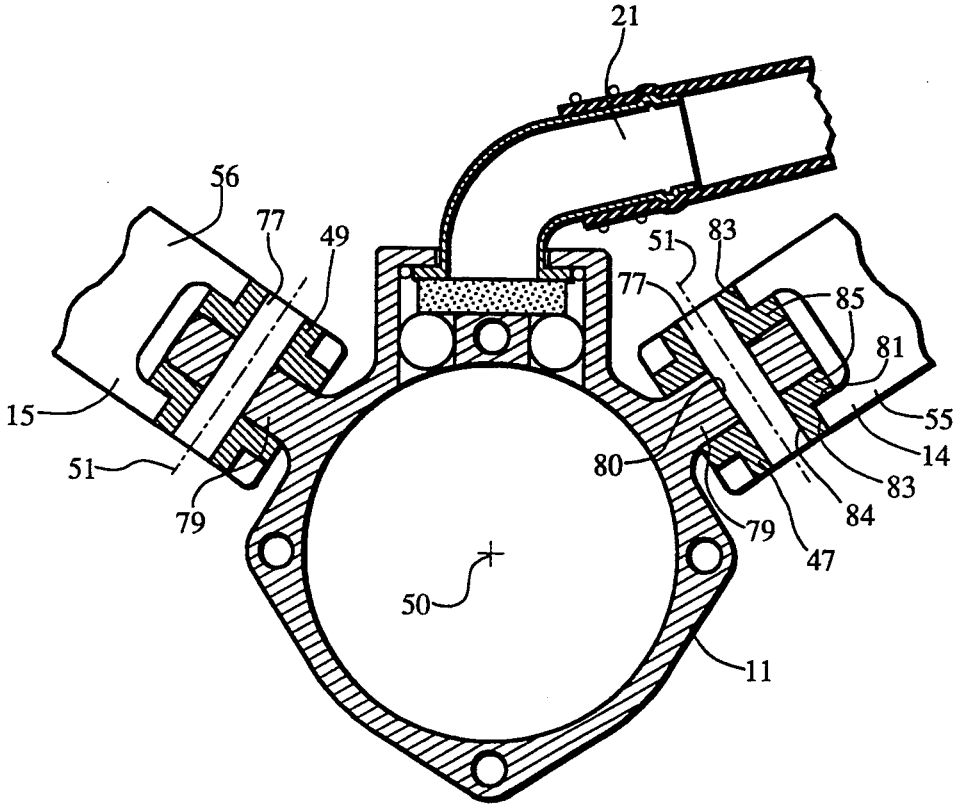
FIGS. 3, 4 and 5 are views taken along lines 3—3, 4—4 and 5—5 of FIG. 1.

In carrying out the present invention, provision is made of a unique arrangement for mounting the handles 14 and 15 on the housing 11 so that the grinder 10 is easier and less tiring to use and is more economical to manufacture. For these purposes, both of the handles include upper and lower ends 36, 37, and 39, 40, respectively, which are secured to the outside of the housing. Between the ends of the handles, gripped portions 41 and 43 of the handles are disposed at a comfortable double angle relative to the grinding wheel spindle 20. As a result, the tool is tilted naturally with the front periphery of the grinding wheel working against the workpiece slightly out of its surface plane. In this position, the operator's wrists are held comfortably straight for freedom of movement of the tool to virtually any position without wrist action and regardless of the orientation of the workpiece whether horizontal, vertical or somewhere in between. Moreover, upper and lower connections utilized in securing each of the handles to the housing are provided with vibration insulators 44, 45, 46, 47, and 49 (see FIGS. 1 and 3) to completely isolate the handles from metal-to-metal contact with the housing. Advantageously, the upper and lower connections include longitudinal axes 50 and 51 which are disposed in directions generally perpendicular to each other. As a result, the handles are kept immobile and yet provide a strong vibration reducing connection allowing solid control maneuvering of the grinder by the operator without the tool wobbling from the handles. In addition to the use advantages provided by the present invention, economy of manufacturing is obtained in construction of the motor housing 11 by virtue of the connection of power air through one of the handles to the top of the housing directly with the motor intake 19. In this way, configuration of the housing is greatly simplified for casting purposes.

In the present instance, both the power and idle handles 14 and 15 are generally c-shaped in configuration, one being generally the mirror image of the other. While the power handle 14 is shown as the right-hand handle and the left handle is the idle handle 15, the general configuration two handles is the same with the lower connection of each being identical and the upper connection similar. One difference between the upper connections is that the connection for the idle handle is above the connection for the power handle. With this arrangement, it is to be appreciated that the power and idle handles may be easily switched, right to left and left to right, to accommodate the handedness of the operator.

Figure 2:
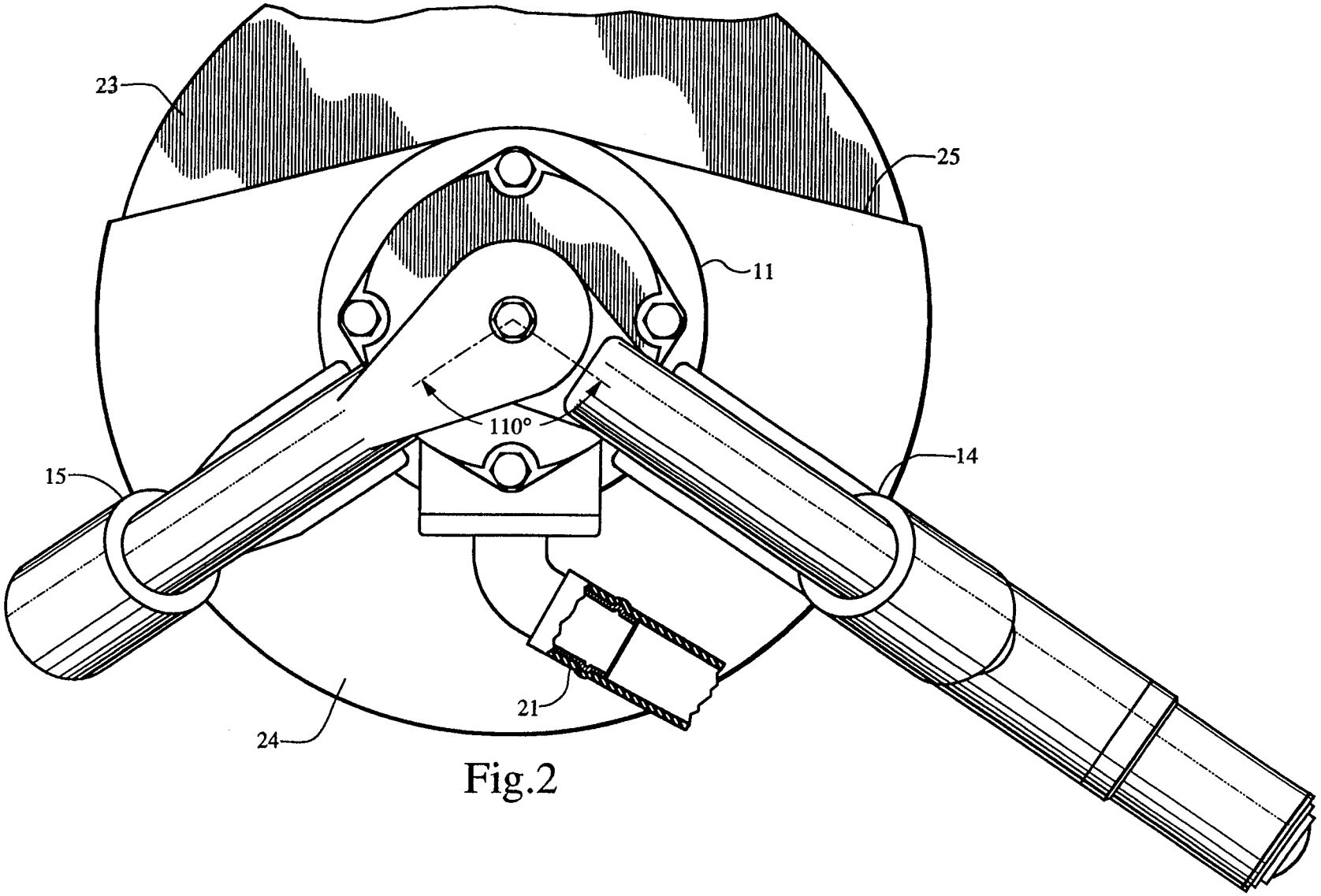
FIG. 2 is a plan view of the air tool shown in FIG. 1.

With reference to FIGS. 1 and 2, the handles 14 and 15 are mounted so as to extend in a generally radial direction from the longitudinal axis 50 of the tool forming an included angle of about 110° (shown in FIG. 2) with respect to each other as measured in a direction opposite the front opening 23 of the disc guard 24. As shown in elevation in FIG. 1, the handles 14 more specifically includes upper and lower legs 53 and 55 with a generally upright leg 57 connected integrally therebetween. Specifically, the upper leg 53 extends in a substantially horizontal direction to connect at the upper end 36 of the handle 14 with the top of the housing. The lower leg 55 of handle 14 is slanted downwardly and radially outward from a connection of its inward end 39 to the housing. Between the upper and lower legs 53 and 55, the upright leg 57 is slanted off of vertical, forming a 15° angle with respect to the longitudinal axis 50 of the grinder. In a similar manner, the handle 15 includes upper and lower legs 54 and 56 with a generally upright leg 58 connected therebetween and forming a fifteen degree (15°) angle with respect to the axis 50. Thus, the upright legs 57 and 58 are each formed at a double angle with respect to the planar surface of the grinding wheel. Advantageously, in use this double angle arrangement allows the operator to easily grip the tool in a comfortable manner keeping wrists straight but naturally tilting the grinding wheel for working against the planar surface or workpiece at a slant angle. As a result, the peripheral edge of the grinding wheel is tilted at an effective working angle.

Figure 4:
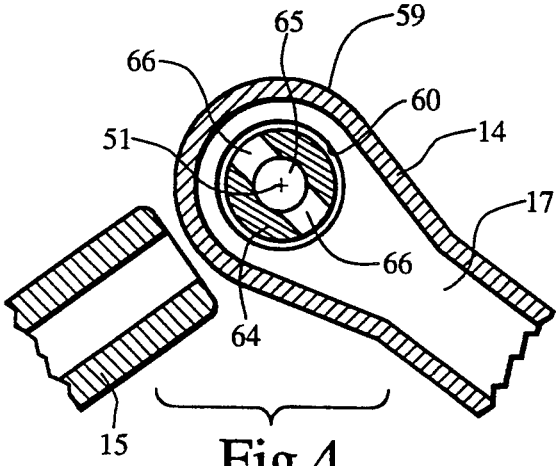

In connecting the upper and lower ends of the handles 14 and 15 to the housing 11, the vibration insulators 44, 45, 46, 47, and 49 are utilized to prevent metal-to-metal contact between the handles and the housing. For the upper connection of the handle 14 to the housing, the upper leg 53 includes an integral connecting ring 59 formed on its inward end. As shown in FIGS. 1 and 4, the ring 59 is integrally formed with the inward end of the upper leg and includes a central opening 60 communicating with the power air passage 17. Around the opening 60 on the upper side of the connecting ring is an annular recess 61. A similar annular recess 63 is formed around the opening 60 on the underside of the ring. To secure the inward end of the power handle to the housing, the opening in the connecting ring is telescoped onto an inlet stud 64. The latter is threaded into the top of the housing 11 and includes a central passage 65 aligned with the motor intake 19. Radial passages 66 formed through the stud communicate between the power handle passage 17 and the inlet stud central passage 65 for power air to flow to the motor.

Figure 5:
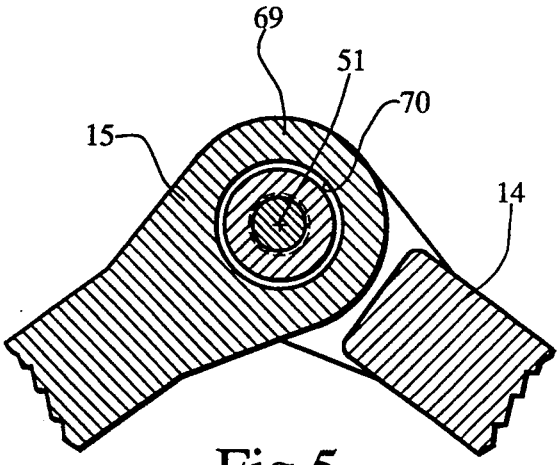

To seal against the loss of power air from between the connecting ring 59 and the inlet stud 64, the vibration insulators 45 and 46 (see FIG. 1) are formed of an elastomeric material such as the vibration isolation/damping thermoplastic material sold under the trademark ISODAMP formulation C-1002 by EAR Specialty Composites, a division of Cabot Safety Corporation. The insulators are nested within the recesses 61 and 63, respectively, and compressed by action of a threaded cap 67 which is secured to an internally threaded socket 68 in the top of the inlet stud 64. The cap 67 also serves to secure the idle handle 15 to the housing 11. In particular, a single sided connector ring 69 (see also FIG. 5) is integrally formed with the inward end of the handle 15. Upper and lower recesses surrounding a central opening 70 through the connector ring receive the vibration insulator rings 44 and 45. As shown in FIG. 1, the cap includes an annular flange 71 with an annular recess 73 formed in the underside thereof so that when the cap is tightened down over the stud 64 all of the vibration insulators 44, 45, and 46 for the upper connections of the handles 14 and 15 are sandwiched towards the top of the housing. Specifically, the lower insulator ring 46 is sandwiched within a lower annular recess 75 formed in the top of the housing and the recess 63 in the connecting ring 59. Advantageously, the diameters of all of the insulator rings and recesses are the same and are such that the outside walls of the insulator rings abut the outer walls of the recesses to limit radial movement of the handles relative to the inlet stud 64. With the sandwiching of the insulator rings 44, 45, and 46 between the inward ends of the handles and the top of the housing, the upper legs of the handles are effectively secured to the housing yet without metal-to-metal contact so that the transmission of vibration from the housing to the handles is kept to a minimum.

At the lower ends 39 and 40 of the handles 14 and 15, the vibration insulators 47 and 49 are utilized to ensure against metal-to-metal contact between the handles and the housing. As shown in FIGS. 1 and 4, the inward ends of the lower legs 55 and 56 are secured in the same manner by means of a pin 77 to bosses 79 protruding from and integrally formed with the housing 11. The bosses extend in a generally radial direction from the central axis 50 of the tool, being spaced one-hundred ten degrees (110°) angularly from each other to set the relative angular spacing of the two handles 14 and 15 from each other. Extending through each of the bosses is a pin bore 80 (see FIG. 3) drilled along the axis 51 extending horizontally generally perpendicular to the radial plane of the bosses. For securing the inward ends of the handles to the bosses, each inward end is formed with a vertical slot 81 defining parallel walls. Centered within the two walls are horizontally aligned insulator bores 83 whose internal diameters are substantially larger than the diameter of the fastener pin 77. Also, the vertical slots 81 are wider than the width of the bosses 79. Seated within the insulator bores 83 of the handles 14 and 15, respectively are the insulator rings 49 and 49. Each ring includes a central opening 84 sized to tightly receive the fastener pin 77. Moreover, the rings include annular flanges 85 sized to fit between the inside surfaces of the slot 81 parallel walls and the outsides of the associated boss 79. In securing the inward end of the lower leg of the handle 14 to the housing, the pin 77 is telescoped through the central opening 84 in the vibration insulator ring 47 and the bore 80 in the boss 79. A lock screw 85 (see FIG. 1) threaded into the boss and set against the pin to key the latter from being vibrated out of the connection during use of the tool. With this arrangement, it is apparent that the connection of the lower end of each handle is securely attached to the housing in a vibration reduced transmitting manner without metal-to-metal contact between the handle and the housing. Importantly, moreover, the connection of each of the handles is found to be particularly solid because of the relative orientation of the axes 50 and 51. Specifically, the axis of the inlet stud 64 and the axis of the upper connection coincides with the axis of motor. The axes of the lower connections for the handles 14 and 15, however, are spaced radially from and extend perpendicular to a vertically extending radial plane through the axis 50.

As shown in FIG. 1, the connections of the lower ends 39 and 40 of the handles 14 and 15, the lower legs 55 and 56 extend downwardly upon progressing radially outward along the upper surface of the guard 24 to connect with the upright legs 57 and 58 of the handles. In the power handle 14, the pivot 29 for the power actuating lever 27 is connected to the lower leg 55 adjacent the periphery of the guard and close to the plane of rotation for the grinding wheel. The idle handle 15 is similarly connected relative to the guard so that both handles in effect loop downwardly enabling the operator to obtain a lower grip on the handles closer to the workpiece. As a result, in service use, the operator is able to obtain better balance and control of the tool to reduce the effort required in maneuvering the grinding wheel to perform work.

Advantageously, in providing power air to the inlet 16 of the handle 14, a swivel connector 86 is utilized. Herein, the swivel comprises a tubular male fitting 87 threaded into a female socket 89 formed in the lower end of the power handle. The male fitting includes an open end 90 communicating with an interior hollow 91 and an opposite blocked end 93. Radial passages 94 communicate with an annulus 95 recessed in an exterior seal surface 96. Surrounding the seal surface is a tubular branch fitting 97. An angled bore 99 in the branch fitting serves as the inlet for the swivel communicating with the annulus. A horizontal bore with an interior sealing surface 100 is telescoped over the sealing surface of the male fitting. O-rings 101 seal between the two sealing surfaces 100 and 96 and a clip ring 103 locks the two fittings 87 and 97 together so that the branch fitting is free to rotate on the male fitting.

Figure 6:
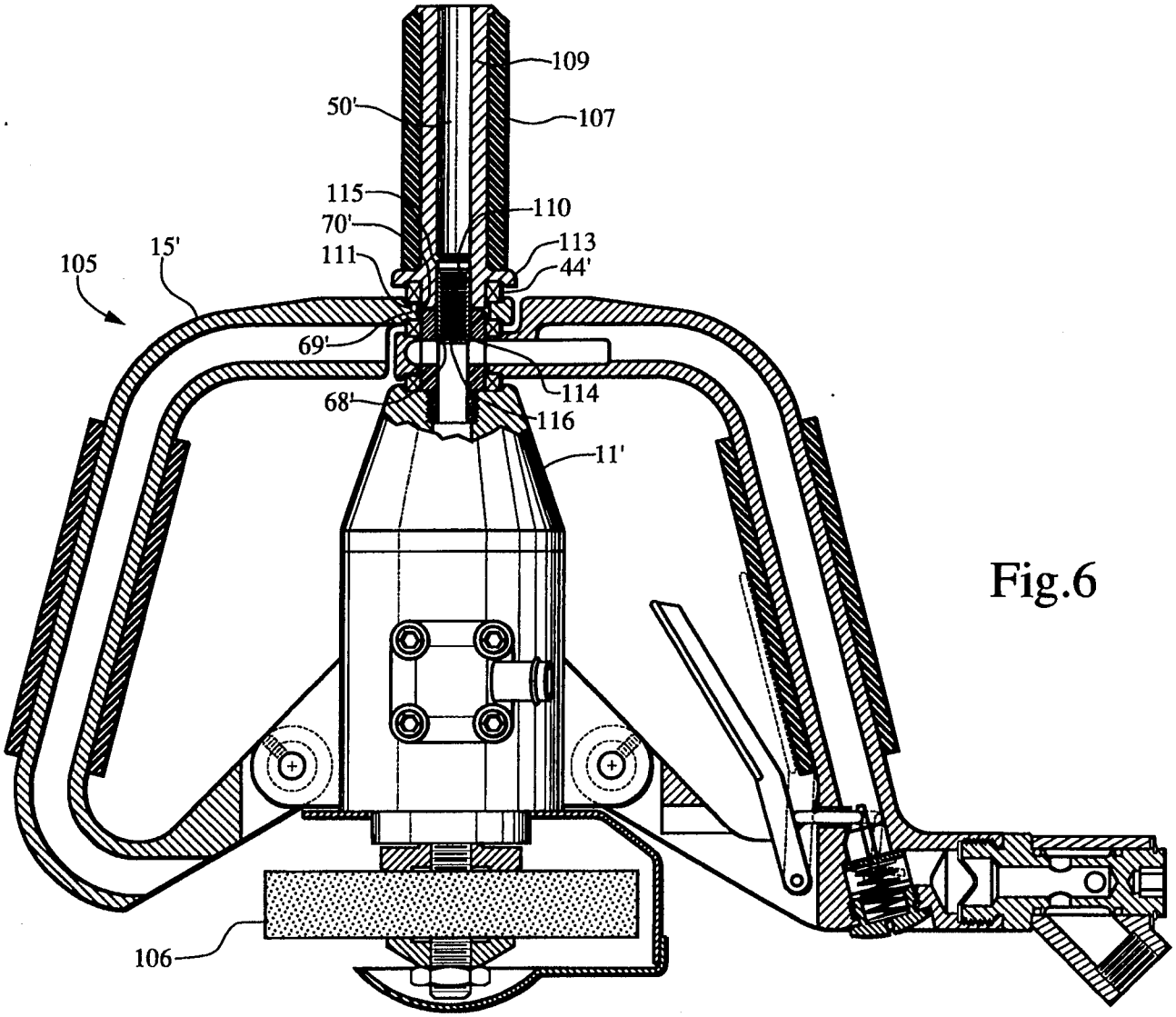
FIG. 6 is a view similar to FIG. 1 but showing an alternate embodiment of the present invention.

An alternative embodiment of the present invention is shown in FIG. 6 and is particularly adapted for incorporating the present invention for use in a horizontal grinder 105. In a horizontal grinder, the working surface of the grinding wheel 106 is primarily the edge surface of the wheel and the grinder is held so that the plane of rotation of the wheel is generally perpendicular to the workpiece surface rather than generally parallel or slightly tilted as is the case with the vertical grinder 10. In this alternative embodiment shown in FIG. 6, the parts corresponding to those of the grinder 10 shown in FIG. 1 are indicated by the same but primed reference numbers. Unless otherwise noted, the description of the parts identified by primed reference numbers is the same as that of the earlier described embodiment and will not be repeated herein.

An important additional feature of the embodiment of the invention shown in FIG. 6 is the provision of an elongate grip 107 attached to and protruding from the housing 11' along the longitudinal axis 50' of the motor (not shown). The grip provides the operator of the tool 105 with an alternate position for his idle hand for most comfortably positioning the tool relative to the workpiece during use. Herein, the grip comprises an elongated tubular metal body 109 having an internally threaded section 110 at a lower end 111 thereof. Spaced from the end 111 is an annular flange 113 integrally forward with the body and protruding radially therefrom. Facing toward the end 111 is an annular recess 113 for receiving the upper vibration isolator 44' when the grip is secured to the housing.

For securing the grip 107 to the housing 11' a fastener in the form of a threaded screw 114 is tightened within the body 109 in the threaded section 110 with the screw seating against an annular stop 115. A portion 116 of the screw extends from the grip through the opening 70' in the idle handle 15' and is secured in the threaded socket 68' of the inlet stud 64' so that the insulator element 44' is compressed between the flange 113 and the connector ring 69' within the recesses 113 and 61'. Thus, the grip 107 is secured to the housing in a vibration reducing manner.

From the foregoing, it will be apparent that the present invention provides a new and improved grinder 10 or 10' which is easier to use and less expensive to manufacture than prior grinders of the same general type. The unique double angled positioning of the power and idle handles 14 and 15 particularly with the upright legs of the handles angled to naturally tilt the grinding wheel at its most effective angle for grinding the surface of a workpiece stops strain on the operator's wrist.

I claim:

1. An air tool including a housing containing an air motor with a shaft rotatable about a longitudinal axis and connectable to an implement for working the surface of a workpiece, a power handle with upper and lower ends connected to said housing, an idle handle spaced angularly from said power handle and having top and bottom ends connected to said housing, said power handle including an air power inlet adjacent the lower end thereof, an air power outlet adjacent the upper end thereof and an air passage communicating therethrough from said inlet to said outlet, an air inlet port in said housing adjacent said upper end of said power handle, said air power outlet being aligned and communicating with said air inlet port, and a sealing element between said housing and said power handle sealing against the loss of air power between said power handle and said housing.

2. An air tool including a housing containing an air motor with a shaft rotatable about a longitudinal axis and connectable to an implement for working the surface of a workpiece, right and left handles having upper and lower ends, and upper and lower connections respectively securing said upper and lower ends of said handles to said housing, said upper and lower connections for each of said handles having longitudinal axes extending in directions generally perpendicular to each other.

3. An air tool as defined by claim 2 wherein said longitudinal axes of said upper connections extend in a direction generally parallel to said longitudinal axis of said shaft.

4. An air tool as defined by claim 2 wherein said longitudinal axes of said lower connections extend in a direction generally perpendicular to said longitudinal axis of said shaft.

5. An air tool as defined by claim 3 wherein one of said handles includes an air power inlet adjacent the lower end thereof, an air power outlet adjacent the upper end thereof and an air passage communicating therethrough from said inlet to said outlet, an air inlet port in said housing adjacent said upper end of said one handle, said air power outlet being aligned and communicating with said air inlet port.

6. An air tool as defined by claim 5 including a vibration insulator within each of said connections of said handles to said housing.

7. An air tool as defined by claim 6 wherein said vibration insulator in said upper connection for said one handle also serves to seal against the loss of air power between said one handle and said housing.

8. An air tool as defined by claim 7 wherein said right and left handles are adapted to be disconnect from said housing and reconnected in switched positions.

9. An air tool including a housing containing an air motor with a shaft rotatable about a longitudinal axis and connectable to an implement for working the surface of a workpiece, right and left handles having upper and lower ends, and upper and lower connections respectively securing said upper and lower ends of said handles to said housing, said handles being angularly spaced from each other by a preselected angle less than one-hundred eighty degrees (180°) relative to said longitudinal axis, each of said handles including upper and lower generally radially extending legs and a substantially upright leg extending therebetween, said lower legs each having radially inward ends secured to said housing by said lower connections, and each of said generally upright legs extending radially inward toward said housing upon progressing upwardly from said lower leg toward said upper leg and having a longitudinal axis angled at approximately 15° with respect to said longitudinal axis of said shaft.

10. An air tool as defined by claim 9 wherein said preselected angle between said right and left handles is generally one hundred ten degrees (110°).

11. An air tool as defined by claim 9 with said lower legs of said handles each extending downwardly from its said lower connection with said housing upon progressing generally radially outward therefrom.

12. An air tool as defined by claim 9 including a vibration insulator within each of said upper and lower connections of said handles to said housing, said insulators avoiding metal to metal contact between said handles and said housing.

13. An air tool as defined by claim 12 wherein one of said handles includes an air power inlet adjacent the lower end thereof, an air power outlet adjacent the upper end thereof and an air passage communicating therethrough from said inlet to said outlet, an air inlet port in said housing adjacent said upper end of said one handle, said air power outlet being aligned and communicating with said air inlet port.

14. An air tool as defined by claim 13 wherein said vibration insulator in said upper connection for said one handle also serves to seal against the loss of air power between said one handle and said housing.

15. An air tool as defined by claim 14 wherein said right and left handles are adapted to be disconnect from said housing and reconnected in switched positions.

16. An air power tool as defined by claim 12 with said upper and lower connections for each of said handles having longitudinal axes extending in directions generally perpendicular to each other.

17. An air tool as defined by claim 16 wherein said longitudinal axes of said upper connections extend in a direction generally parallel to said longitudinal axis of said shaft.

18. In an air tool including a housing containing an air motor with a shaft connected to an implement for working the surface of a workpiece, the improvement comprising a power handle removably connected to said housing, an idle handle removably connected to said housing and spaced less than 180° arcuately from said power handle, each of said handles being connected to said housing at upper and lower positions, a vibration insulator at each of said connections, said power handle including an air power inlet and an air passage extending therethrough from said inlet to said housing adjacent the upper connection of said power handle, said vibration insulator at said upper power handle connection also serving to seal against the loss of air power between said power handle and said housing, each of said handles including upper and lower generally radially extending legs and a substantially upright leg extending between the radially outer most ends of said generally radial legs, said lower leg of each of said handles also extending downwardly from said connection with said housing upon progressing radially outward therefrom, and each of said generally upright legs extending radially inward toward said housing upon progressing upwardly from said lower leg toward said upper leg.

19. In an air tool including a housing containing an air motor with a shaft rotatable about a longitudinal axis and connectable to an implement for working the surface of a workpiece, the improvement comprising a power handle removably connected to said housing, an idle handle removably connected to said housing and spaced less than one-hundred eighty degrees (180°) arcuately from said power handle, upper and lower connections for each of said handles to said housing, a vibration insulator at each of said connections, said power handle including an air power inlet and an air passage extending therethrough, an air inlet port in said housing adjacent said upper connection of said power handle, said air passage communicating with said air inlet port, said vibration insulator at said upper power handle connection surrounding said air inlet port and also serving to seal against the loss of air power between said power handle and said housing, each of said handles including upper and lower generally radially extending legs and a substantially upright leg extending therebetween, said lower legs each having radially inward ends secured to said housing by said lower connections and said lower legs each extending downwardly from its said lower connection with said housing upon progressing generally radially outward therefrom, and each of said generally upright legs extending radially inward toward said housing upon progressing upwardly from said lower leg toward said upper leg.

20. An air tool as defined in claim 19 wherein said upper connection for said power handle includes an integral connecting ring, an inlet stud protruding from said housing in a first direction generally parallel to said longitudinal axis and having said air inlet port formed therein, said connecting ring being telescoped onto said stud with said air passage aligned with said inlet port, and upper and lower annular recesses and formed in said connecting ring around said stud above and below said inlet port, said insulators being nested one in each of said recesses, and a fastener connected to said housing and compressing said insulators to seal against the leakage of power air between said stud and said connecting ring.

21. An air tool as defined in claim 20 wherein said upper connection for said idle handle includes an integral connector ring telescoped onto said stud, said connector ring having upper and lower annular grooves formed therein, said insulators being nested one in each of said grooves and held therein by said fastener to anchor said idle handle to said housing.

22. An air tool as defined in claim 21 wherein said lower connections each include a fastener pin connecting said inward end to said housing, said fastener pins each having a longitudinal axis extending in a second direction generally perpendicular to said first direction, lower ones of said insulators supported between said fastener pins and said inward ends.

23. An air tool including a housing containing an air motor with a shaft rotatable about a longitudinal axis and connectable to an implement for working the surface of a workpiece, a power handle with upper and lower ends connected to said housing, an idle handle spaced angularly from said power handle and having top and bottom ends connected to said housing, a grip attached to and protruding from said housing with an elongate axis substantially aligned with said longitudinal axis of said shaft, said power handle including an air power inlet adjacent the lower end thereof, an air power outlet adjacent the upper end thereof and an air passage communicating therethrough from said inlet to said outlet, an air inlet port in said housing adjacent said upper end of said power handle, said air power outlet being aligned and communicating with said air inlet port, and a sealing element between said housing and said power handle sealing against the loss of air power between said power handle and said housing.

24. An air tool including a housing containing an air motor with a shaft rotatable about a longitudinal axis and connectable to an implement for working the surface of a workpiece, a grip attached to and protruding from said housing with an elongate axis substantially aligned with said longitudinal axis of said shaft, right and left handles having upper and lower ends, and upper and lower connections respectively securing said upper and lower ends of said handles to said housing, said handles being angularly spaced from each other by a preselected angle less than one-hundred eighty degrees (180°) relative to said longitudinal axis, each of said handles including upper and lower generally radially extending legs and a substantially upright leg extending therebetween, said lower legs each having radially inward ends secured to said housing by said lower connections, and each of said generally upright legs extending radially inward toward said housing upon progressing upwardly from said lower leg toward said upper leg and having a longitudinal axis angled at approximately 15° with respect to said longitudinal axis of said shaft.

25. In an air tool including a housing containing an air motor with a shaft connected to an implement for working the surface of a workpiece, the improvement comprising a grip attached to and protruding from said housing with an elongate axis substantially aligned with said longitudinal axis of said shaft, a power handle removably connected to said housing, an idle handle removably connected to said housing and spaced less than 180° arcuately from said power handle, each of said handles being connected to said housing at upper and lower positions, a vibration insulator at each of said connections, said power handle including an air power inlet and an air passage extending therethrough from said inlet to said housing adjacent the upper connection of said power handle, said vibration insulator at said upper power handle connection also serving to seal against the loss of air power between said power handle and said housing, each of said handles including upper and lower generally radially extending legs and a substantially upright leg extending between the radially outer most ends of said generally radial legs, said lower leg of each of said handles also extending downwardly from said connection with said housing upon progressing radially outward therefrom, and each of said generally upright legs extending radially inward toward said housing upon progressing upwardly from said lower leg toward said upper leg.

26. In an air tool including a housing containing an air motor with a shaft rotatable about a longitudinal axis and connectable to an implement for working the surface of a workpiece, the improvement comprising a grip attached to and protruding from said housing with an elongate axis substantially aligned with said longitudinal axis of said shaft, a power handle removably connected to said housing, an idle handle removably connected to said housing and spaced less than one-hundred eighty degrees (180°) arcuately from said power handle, upper and lower connections for each of said handles to said housing, a vibration insulator at each of said connections, said power handle including an air power inlet and an air passage extending therethrough, an air inlet port in said housing adjacent said upper connection of said power handle, said air passage communicating with said air inlet port, said vibration insulator at said upper power handle connection surrounding said air inlet port and also serving to seal against the loss of air power between said power handle and said housing, each of said handles including upper and lower generally radially extending legs and a substantially upright leg extending therebetween, said lower legs each having radially inward ends secured to said housing by said lower connections and said lower legs each extending downwardly from its said lower connection with said housing upon progressing generally radially outward therefrom, and each of said generally upright legs extending radially inward toward said housing upon progressing upwardly from said lower leg toward said upper leg.

27. An air tool as defined in claim 26 wherein said upper connection for said power handle includes an integral connecting ring, an inlet stud protruding from said housing in a first direction generally parallel to said longitudinal axis and having said air inlet port formed therein, said connecting ring being telescoped onto said stud with said air passage aligned with said inlet port, and upper and lower annular recesses and formed in said connecting ring around said stud above and below said inlet port, said insulators being nested one in each of said recesses, and a fastener securing said grip to said air inlet stud and compressing said insulators to seal against the leakage of power air between said stud and said connecting ring.

28. An air tool as defined in claim 27 wherein said upper connection for said idle handle includes an integral connector ring telescoped onto said stud, said connector ring having upper and lower annular grooves formed therein, said insulators being nested one in each of said grooves and held therein by said fastener to anchor said idle handle to said housing.

29. An air tool as defined by claim 28 wherein said grip includes a tubular body, having a radially protruding flange integrally formed with one end thereof and engaging said insulator nested in said upper groove of said idle handle, said fastener comprising a screw connected between said tubular body and said inlet stud.

* * * * *